US005957373A

United States Patent [19]

Sarazen, Jr. et al.

[11] Patent Number: 5,957,373

[45] Date of Patent: Sep. 28, 1999

[54] AUTOMATIC VENTILATOR WITH MANUAL OVERRIDE

[75] Inventors: Paul M. Sarazen, Jr.; Dennis A. Beam, Jr., both of Shelby, N.C.

[73] Assignee: Temp-Vent Corporation, Shelby, N.C.

[21] Appl. No.: 09/005,888

[22] Filed: Jan. 12, 1998

[51] Int. Cl.[6] ..... F24F 13/14

[52] U.S. Cl. ..... 236/49.5; 454/258

[58] Field of Search ..... 236/49.5, 49.2; 454/258, 271, 273; 137/637; 251/74, 304, 305

[56] References Cited

U.S. PATENT DOCUMENTS

| | | | |
|---|---|---|---|
| 302,215 | 7/1884 | Tucker . | |
| 1,335,929 | 4/1920 | Allen . | |
| 1,358,193 | 11/1920 | Fulton . | |
| 2,117,259 | 5/1938 | Wile et al. . | |
| 2,187,767 | 1/1940 | Akers . | |
| 2,216,873 | 10/1940 | Browne . | |
| 2,241,108 | 5/1941 | Akers . | |
| 2,551,965 | 5/1951 | Petersen et al. . | |
| 2,669,923 | 2/1954 | Knepper | 236/49.5 |
| 2,814,977 | 12/1957 | Noll . | |
| 2,975,975 | 3/1961 | Weber . | |
| 3,027,090 | 3/1962 | Zerhan, Jr. . | |
| 3,068,776 | 12/1962 | Day . | |
| 3,195,441 | 7/1965 | Hedrick . | |
| 3,368,756 | 2/1968 | Edwards . | |
| 3,378,199 | 4/1968 | Snell | 236/49.5 |
| 3,436,016 | 4/1969 | Edwards . | |
| 3,528,606 | 9/1970 | Witten . | |
| 4,113,230 | 9/1978 | MCabe | 251/303 |
| 4,151,952 | 5/1979 | Edwards . | |
| 4,175,480 | 11/1979 | Beam, Jr. et al. . | |
| 4,208,010 | 6/1980 | Beam, Jr. et al. . | |
| 4,210,279 | 7/1980 | McSwain . | |
| 4,231,514 | 11/1980 | McSwain . | |
| 4,243,175 | 1/1981 | McSwain . | |
| 4,274,330 | 6/1981 | Witten et al. . | |
| 4,290,554 | 9/1981 | Hensley . | |
| 4,328,927 | 5/1982 | McSwain . | |
| 4,493,456 | 1/1985 | Sarazen, Jr. et al. . | |
| 4,669,371 | 6/1987 | Sarazen, Jr. et al. . | |
| 4,699,045 | 10/1987 | Hensley . | |
| 4,715,532 | 12/1987 | Sarazan, Jr. et al. . | |
| 4,754,696 | 7/1988 | Sarazen et al. . | |
| 4,817,912 | 4/1989 | McCabe | 236/49.2 |
| 4,821,628 | 4/1989 | Sarazen . | |
| 4,911,065 | 3/1990 | Van Becelaere | 236/49.2 |
| 4,962,882 | 10/1990 | Sarazen . | |
| 5,253,804 | 10/1993 | Sarazen, Jr. et al. . | |
| 5,294,049 | 3/1994 | Trunkle et al. . | |

FOREIGN PATENT DOCUMENTS

| | | |
|---|---|---|
| 1377998 | 9/1964 | France . |

*Primary Examiner*—William E. Tapolcal
*Attorney, Agent, or Firm*—Dority & Manning, P.A.

[57] ABSTRACT

A ventilator is selectively configured so that it can automatically open and close its louvers according to the temperature in its environment or have its louvers manually positioned in either the open or closed orientation. The louvers are disposed in an air passageway that is defined by a housing. A bimetallic coil acts through a drive element and a linkage element to automatically open and close the louvers of the ventilator. A pair of override members have respective handles accessible to the user. Manipulation of the override members enables the user to override the automatic drive element to manually open and close the louvers.

25 Claims, 5 Drawing Sheets

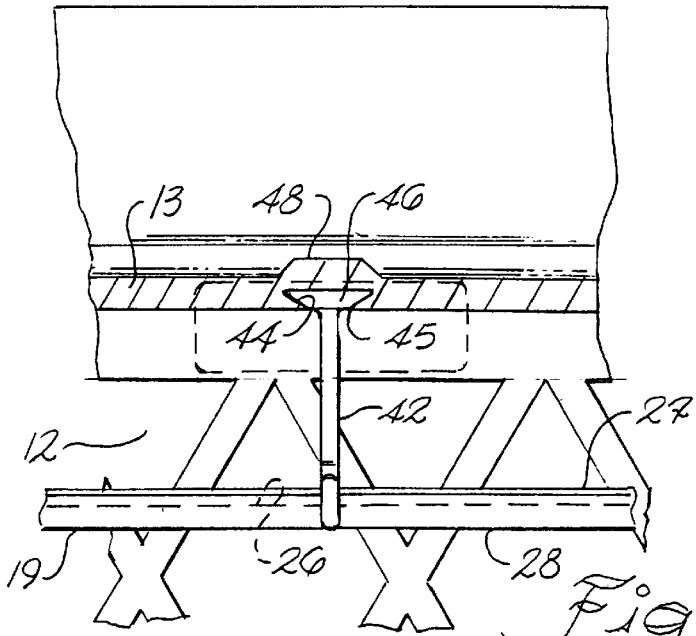
Fig. 5
Fig. 6A
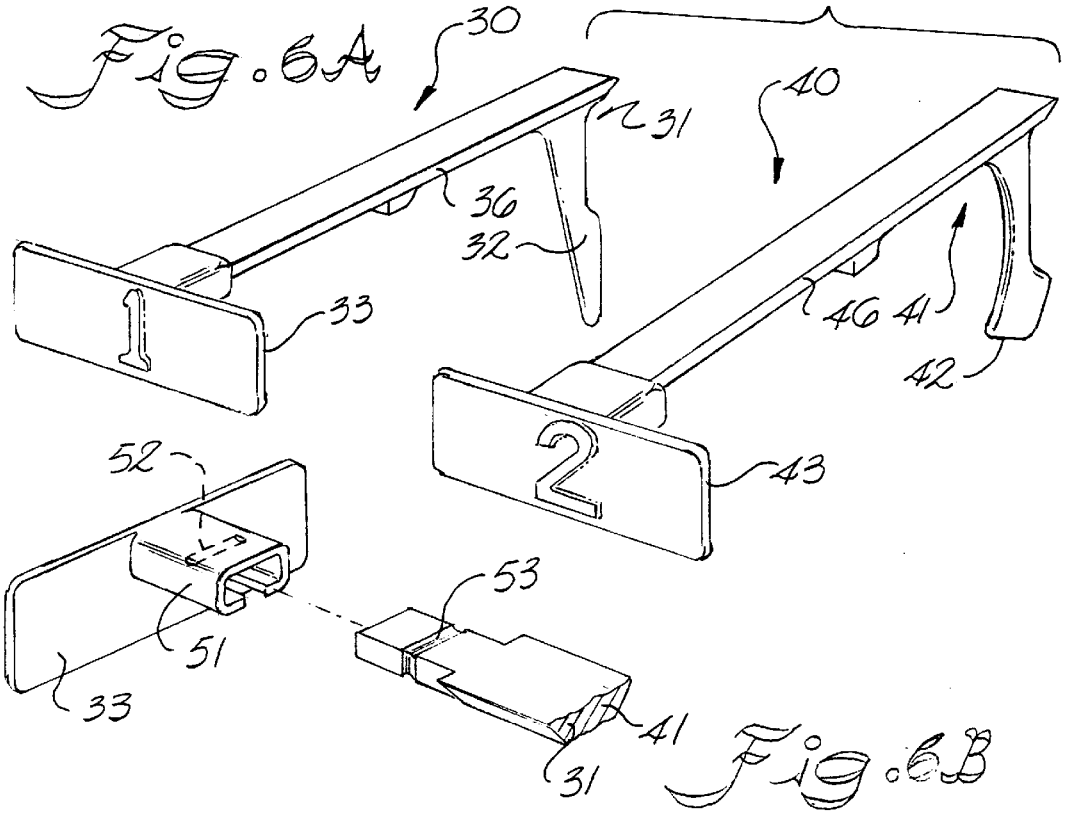
Fig. 6B 29
10
11
13
27
19
23
37
12
27
14
21
24
20
25
17
12
19a
37a
20
18
39
27
21
22
19b
37b
20
21
26
28
22
16

AUTOMATIC VENTILATOR WITH MANUAL OVERRIDE

BACKGROUND OF THE INVENTION

The present invention relates to a ventilator structure of the type that is normally disposed in the foundation of a dwelling or other building structure. More particularly, the present invention relates to a ventilator with automatic, temperature responsive means for opening and closing the ventilator to the passage of air therethrough.

A number of automatic, temperature responsive ventilators are known, including French Patent No. 1,377,998 and those disclosed in the following U.S. Patents:

| U.S. Pat. No. | Inventive Entity |
|---|---|
| 4,962,882 | Sarazen et al |
| 4,754,696 | Sarazen et al |
| 4,715,532 | Sarazen, Jr. et al |
| 4,493,456 | Sarazen, Jr. et al |
| 4,328,927 | McSwain |
| 4,290,554 | Hensley |
| 4,274,330 | Witten et al |
| 4,243,175 | McSwain |
| 4,231,514 | McSwain |
| 4,210,279 | McSwain |
| 4,208,010 | Beam, Jr. et al |
| 4,175,480 | Beam, Jr. et al |
| 4,151,952 | Edwards |
| 3,528,606 | Witten |
| 3,436,016 | Edwards |
| 3,368,756 | Edwards |
| 3,195,441 | Hedrick |
| 3,068,776 | Day |
| 3,027,090 | Zerhan, Jr. |
| 2,975,975 | Weber |
| 2,814,977 | Noll |
| 2,551,965 | Petersen et al |
| 2,241,108 | Akers |
| 2,216,873 | Browne |
| 2,187,767 | Akers |
| 2,117,529 | Wile et al |
| 1,358,193 | Fulton |
| 1,335,929 | Allen |
| 302,215 | Tucker |

A bimetallic element provides a temperature operative mechanism that automatically opens and closes the shutter elements of many of these vents.

However, there are occasions when it is desirable to have the vent either open or closed during a time when the temperature would dictate the contrary condition. For example, during the winter when the temperature would cause the ventilator to be closed, a pipe may break and spill water in the crawl space. Under such circumstances, it would be desirable to be able to open the ventilator to let the crawl space dry out faster. Similarly, in the summer when the temperature would cause the ventilator to be open, high humidity would make it desirable to be able to close the ventilator to prevent the humid air from entering the crawl space.

OBJECTS AND SUMMARY OF THE INVENTION

It is a principal object of the present invention to provide an automatic, temperature-actuating ventilator that is configured so as to permit the operator to be able to selectively, manually override the automatic opening and closing mechanism and thereby permit the ventilator to be selectively configured in either the open or closed condition.

It is another principal object of the present invention to provide an automatic, temperature-actuating ventilator that is configured so as to permit the operator to be able to selectively, manually override the automatic opening and closing mechanism and thereby permit the ventilator to be selectively configured in the open condition.

It is a further object of the present invention to provide an automatic, temperature-actuating ventilator that is configured so as to permit the operator to be able to selectively, manually override the automatic opening and closing mechanism and thereby permit the ventilator to be selectively configured in the closed condition.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, a preferred embodiment of the automatic, temperature-actuating ventilator with manual override of the present invention comprises a housing defining an air passageway. The ventilator also includes a means for selectively opening and closing the air passageway depending upon the temperature of the surrounding atmosphere. This temperature dependent opening and closing means can include at least one louver disposed in the air passageway, and desirably includes a plurality of louvers rotatably disposed across the air passageway. At one rotational position of the louvers, the air passageway is open and admits air and light through the ventilator. In another position of the louvers, the air passageway is closed to prevent air and light from passing through the ventilator.

In accordance with the present invention, a first override member is provided. The first override member is configured and disposed with respect to the housing so that when the first override member is selectively placed in a first position relative to the housing, the temperature dependent opening and closing means is held in an open orientation relative to the passageway. Moreover, when the first override member is selectively placed in at least a second position relative to the housing, the temperature dependent opening and closing means is released from being held in the open orientation. The first override member desirably includes a first main body, a first handle connected to one end of the first main body, and a first cam member extending generally normally from the other end of the first main body.

In accordance with the present invention, a second override member is provided. The second override member is configured and disposed with respect to the housing so that when the second override member is selectively placed in a first position relative to the housing, the temperature dependent opening and closing means is held in a closed orientation relative to the passageway. Moreover, when the second override member is selectively placed in at least a second position relative to the housing, the temperature dependent opening and closing means is released from being held in the closed orientation. The second override member desirably includes a second main body, a second handle connected to one end of the second main body, and a second cam member extending generally normally from the second main body.

For each of the override members, there can be provided a means for selectively, slidably translating the override member with respect to the housing. This selectively slidably translating means can include a guide forming part of one of the override member and the housing. This selectively slidably translating means also can include a slide forming part of the other one of the override member and the housing. The slide is slidably retained by the guide and configured for selective slidable translation relative to the guide.

The ventilator also can include a means for linking the louvers for simultaneous rotation about the longitudinal axis of rotation of each louver. The linking means can include a linkage element that is pivotally connected to each louver at a different site along the length of the linkage element. Preferably, a bimetallic element in the form of a concentrically wound coil spring provides the motive force that opens and closes the louvers in response to temperature changes in the environment of the ventilator. When configured for automatic operation, the particular position of the louvers is determined by the temperature conditions, because the temperature causes the bimetallic coil to expand and contract, which is translated into louver movement, as explained more fully below.

The accompanying drawings, which are incorporated in and constitute a part of this specification, disclose illustrative preferred embodiments of the invention and, together with the description, serve to explain the principles of the invention. The particular details of each of the foregoing named elements of the apparatus of the present invention, including their configurations and interrelationships, are described below and in the drawings, in which like components are identically numbered.

BRIEF DESCRIPTION OF THE DRAWINGS

FIG. 5 illustrates an expanded detail plan view taken along the lines 5—5 of FIG. 4 and having certain features shown in phantom with dashed lines;

FIG. 6A illustrates an elevated perspective view of the two override members of the present invention;

FIG. 6B illustrates an elevated perspective view of components of the override members of the present invention;

DETAILED DESCRIPTION OF THE PREFERRED EMBODIMENTS

Figure 1:
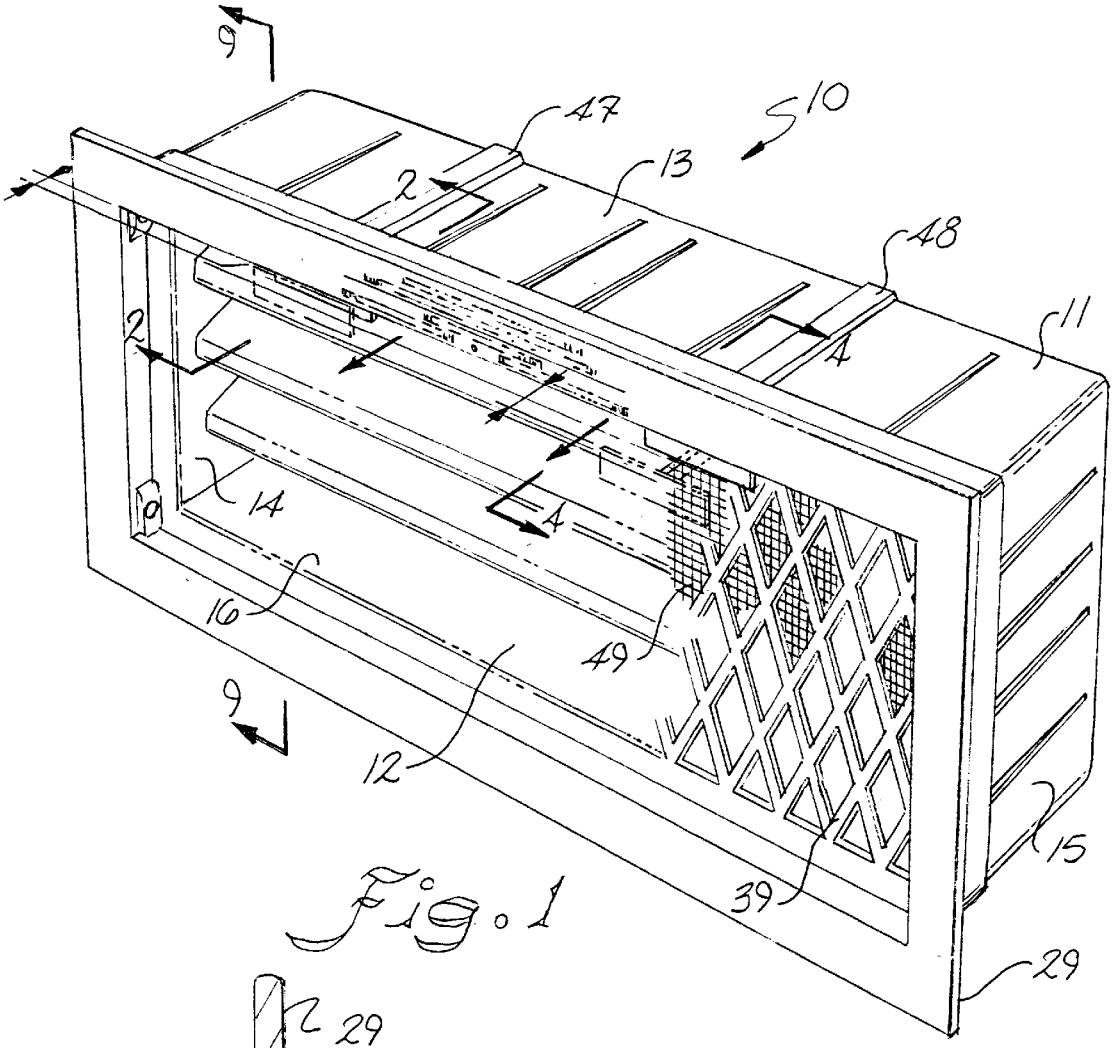
FIG. 1 illustrates an elevated front perspective view of an embodiment of the ventilator of the present invention.

Reference now will be made in detail to the presently preferred embodiments of the invention, one or more examples of which are illustrated in the accompanying drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations as come within the scope of the appended claims and their equivalents. Repeat use of reference characters throughout the present specification and appended drawings is intended to represent the same or analogous features or elements of the invention.

Figure 9:
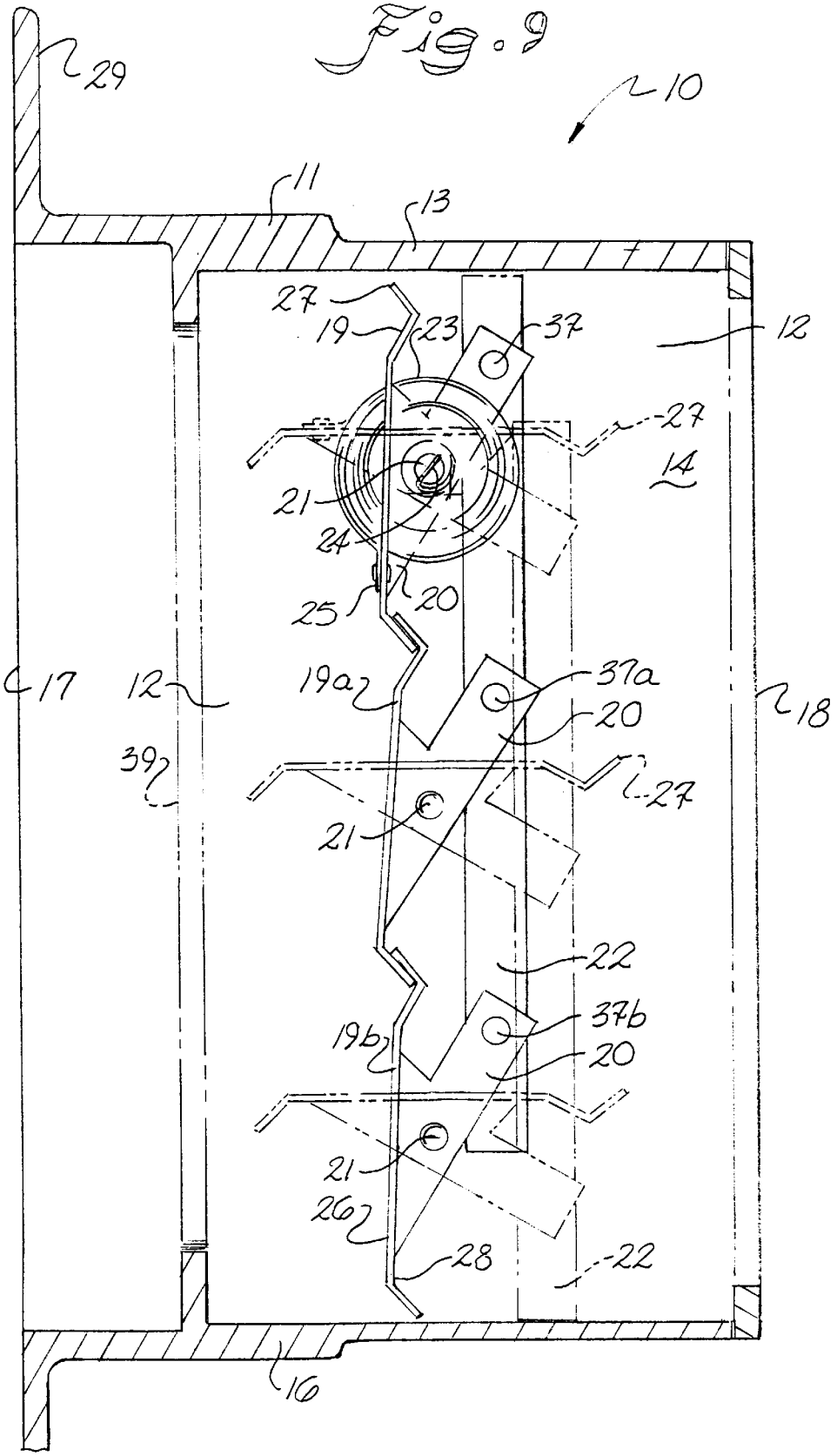
FIG. 9 illustrates a cross-sectional view taken along the lines 9—9 of FIG. 1 with one orientation of the louvers shown in solid line and another orientation of the louvers shown in dashed line.

In accordance with the present invention, a presently preferred embodiment of the temperature actuating ventilator with manual override, is generally indicated in FIGS. 1 and 9 by the designating numeral 10. As shown in FIG. 9, ventilator 10 includes a housing 11 defining an air passageway 12 therethrough. Ventilator 10 also includes a means for selectively opening and closing passageway 12 depending upon the temperature of the surrounding atmosphere. This temperature dependent opening and closing means desirably includes at least one louver 19 disposed in air passageway 12 of housing 11. As embodied herein, the temperature dependent opening and closing means desirably includes at least a second louver 19*a* and a third louver 19*b* disposed in air passageway 12 of housing 11. As shown in FIG. 9, each louver preferably is configured with a transverse cross-section that defines a generally S-shaped configuration and includes a flat upper surface 26, a rearward-extending free edge 27 and a back surface 28.

The structure and operation of housing 11 and the temperature dependent opening and closing means, can be conventional and therefore the same as the structure and operation of any of a number of temperature-responsive ventilators such as disclosed in one or more of the following U.S. Patents, the disclosures of such Patents being hereby incorporated into this patent application by this reference:

| U.S. Pat. No. | Inventive Entity |
|---|---|
| 4,962,882 | Sarazen, Jr. et al |
| 4,754,696 | Sarazen et al |
| 4,715,532 | Sarazen, Jr. et al |
| 4,669,371 | Sarazen, Jr. et al |
| 4,493,456 | Sarazen, Jr. et al |
| 4,328,927 | McSwain |
| 4,290,554 | Hensley |
| 4,274,330 | Witten et al |
| 4,243,175 | McSwain |
| 4,231,514 | McSwain |
| 4,210,279 | McSwain |
| 4,208,010 | Beam, Jr. et al |
| 4,175,480 | Beam, Jr. et al |
| 4,151,952 | Edwards |
| 3,528,606 | Witten |
| 3,436,016 | Edwards |
| 3,368,756 | Edwards |
| 3,195,441 | Hedrick |
| 3,068,776 | Day |

Each louver 19, 19*a*, 19*b* defines a longitudinal axis of rotation which would be in the direction perpendicular to the plane of the paper on which FIG. 9 is depicted. Rotation of each louver 19, 19*a*, 19*b* about its longitudinal axis functions to open the air passageway 12 to admit air and light through ventilator 10 in at least one position of the louvers shown in dashed line in FIG. 9 and functions to close the air passageway to prevent air and light from passing through passageway 12 of the ventilator in at least a second position of the louvers shown in solid line in FIG. 9. Intermediate positions permit varying degrees of air and light to pass through the ventilator.

As embodied herein and shown in one of FIGS. 1 and/or 9 for example, housing 11 preferably defines a unitary, molded plastic structure that includes a top wall 13, a first sidewall 14, a second sidewall 15 disposed opposite first sidewall 14, and a bottom wall 16 disposed opposite top wall 13. As shown in FIG. 9 for example, housing 11, and accordingly each of top wall 13, bottom wall 16, and sidewalls 14, 15, all of which define housing 11, defines a front edge 17 and a rear edge 18 disposed opposite front edge 17. As shown in FIG. 1, the housing further preferably defines a front edge collar 29 around the periphery thereof and a grille 39 extending across air passageway 12. The unitary construction of the housing also preferably extends to include the collar 29 and the grille 39. A nylon or metallic fine mesh screen 49 can be provided across the grille 39 and can be adhered to same by melt welding the screen to the plastic grille.

Figure 4:
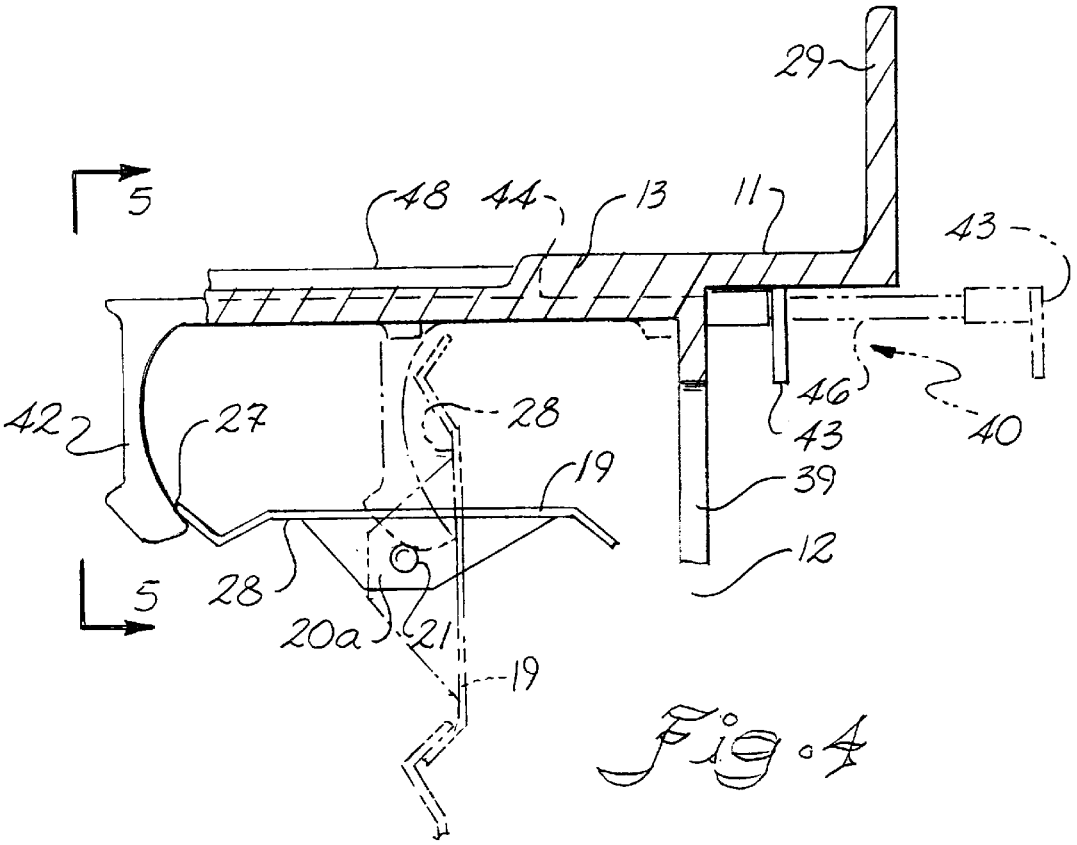
FIG. 4 illustrates a cross-sectional view taken along the lines 4—4 of FIG. 1 and having a guide, a louver and an override member shown in phantom with dashed lines.

The temperature dependent opening and closing means further includes a means for supporting each of the louvers for rotation about the longitudinal axis of rotation. As embodied herein and shown in FIG. 9 for example, the rotational supporting means can include for each louver 19, 19*a*, 19*b*, a support flange 20 pivotally mounted on a support post 21 connected to a first sidewall 14 of louver housing 11. As shown in FIG. 4, the rotational supporting means also can include for each louver 19, 19*a*, 19*b*, a support flange 20*a* pivotally mounted on a support post 21 connected to second sidewall 15 of louver housing 11.

The temperature dependent opening and closing means also includes means for linking the louvers for simultaneous rotation about each pivoting longitudinal axis of rotation of each of the louvers. As embodied herein and shown in FIG. 9 for example, the linking means desirably includes an elongated linkage element 22. As shown in FIG. 9, linkage element 22 is pivotally connected at a first site 37 of element 22, to first louver 19 via a foot portion of support flange 20. Element 22 is pivotally connected to second louver 19*a* at a second site 37*a* of element 22 that is separated from the first site 37 along the length of linkage element 22. Similarly, each additional louver 19*b* is pivotally connected to linkage element 22 at a site 37*b* that is spaced apart along the length of linkage element 22 from each adjacent pivotal connection site 37*a*. Thus, linkage element 22 is pivotally connected to at least one of the louvers 19, 19*a*, 19*b* and desirably connected pivotally to each of the louvers 19, 19*a*, 19*b* via respective support flanges 20.

In still further accordance with the present invention, the temperature dependent opening and closing means also includes a means for sensing the temperature in the environment of the ventilator of the present invention and providing a force for selectively driving the opening and closing of the ventilator to the passage of air therethrough depending on the sensed temperature. As embodied herein and shown in FIG. 9 for example, the temperature sensing and driving means preferably defines a bimetallic coil 23, which expands and contracts according to the temperature of its environment. Bimetallic coil 23 has an inner free end 24 disposed at the innermost portion of the coil and an outer free end 25 disposed at the outermost circumference of the coil. In the embodiment shown, the outer end 25 of bimetallic coil 23 engages first louver 19, either directly as shown or via support flange 20. The opposite free end 24 disposed inside the coil 23 is connected to housing 11 and is desirably anchored to a structure such as a plug that forms support post 21 and is connected to one of the sidewalls 14 defining passageway 12 of louver housing 11.

In operation, the expansion or contraction of coil 23 shown in FIG. 9 is transmitted to the louvers by movement of outer end 25 of coil 23. This movement results because inner end 24 is held fixed to one of the sidewalls 14 defining the air passageway 12 of the louver housing 11. Movement of outer end 25 of coil 23 causes first louver 19 and its attached support flange 20 to pivot about its support post 21. This pivotal movement of support flange 20 causes linkage element 22, which is itself pivotally connected to support flange 20, to undergo translational movement in a direction along the line of sight between top wall 13 and bottom wall 16 of housing 11. Such translational movement of linkage element 22 results in pivoting movement of second and third louvers 19*a*, 19*b*, which are pivotally mounted at respective sites 37, 37*a*, 37*b* to linkage element 22 via respective foot portions of support flanges 20. In so doing, coil 23 provides the necessary force to open and close ventilator 10 to the passage of air therethrough. Other embodiments of the temperature dependent louver housing opening and closing means are disclosed in the temperature dependent ventilators listed above.

In accordance with the present invention, an override member is provided. Since this is the first such override member being discussed herein, it can be referred to herein as the first override member. The first override member is configured and disposed with respect to the housing so that when the first override member is selectively placed in a first position relative to the housing, the temperature dependent opening and closing means is held in an open orientation relative to the passageway. This open orientation of the temperature dependent opening and closing means is shown in FIG. 9 by the louvers 19, 19*a*, 19*b* drawn in dashed lines and in FIGS. 2 and 4 by the louver 19 drawn in solid lines. Because the first override member is associated with maintaining this open orientation of air passageway 12, the first override member also can be referred to herein as the open override member. Moreover, when the first override member is selectively placed in at least a second position relative to the housing, the temperature dependent opening and closing means is released from being held in the open orientation. This condition of being released from the open orientation of the temperature dependent opening and closing means is shown in FIG. 2 for example by the louver 19 drawn in dashed lines.

Figure 2:
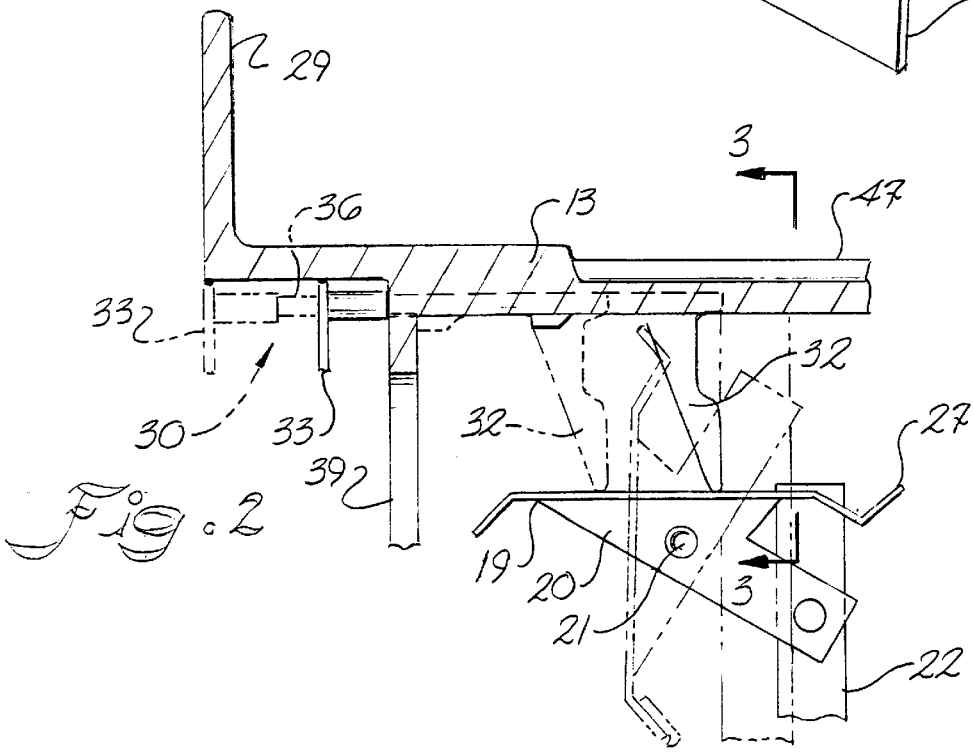
FIG. 2 illustrates a cross-sectional view taken along the lines 2—2 of FIG. 1 and having a louver and override member shown in phantom with dashed lines.

As embodied herein and shown in FIGS. 6*a* and 2 for example, an open (or first) override member is generally designated by the numeral 30. First override member 30 includes a first main body 31 extending generally along a longitudinal axis of symmetry thereof. First override member 30 includes a first cam member 32 extending generally normally from first main body 31. As shown in FIG. 6B, the override member also includes a first handle 33. As shown in FIGS. 2 and 6A for example, first handle 33 is configured to be connected together with first main body 31 to become integral with first main body 31 in the assembled ventilator. This can be accomplished by a sleeve 51 formed on handle 33 and having an internally disposed detent 52 (dashed line in FIG. 6A) that engages a complementarily configured groove 53 formed in one end of first main body 31. Alternatively, the location of these connecting components can be reversed if desired. Moreover, as shown in FIG. 2, first handle 33 of first override member 30 is configured and disposed relative to housing 11 so as to be accessible manually by an operator of the ventilator.

Figure 3:
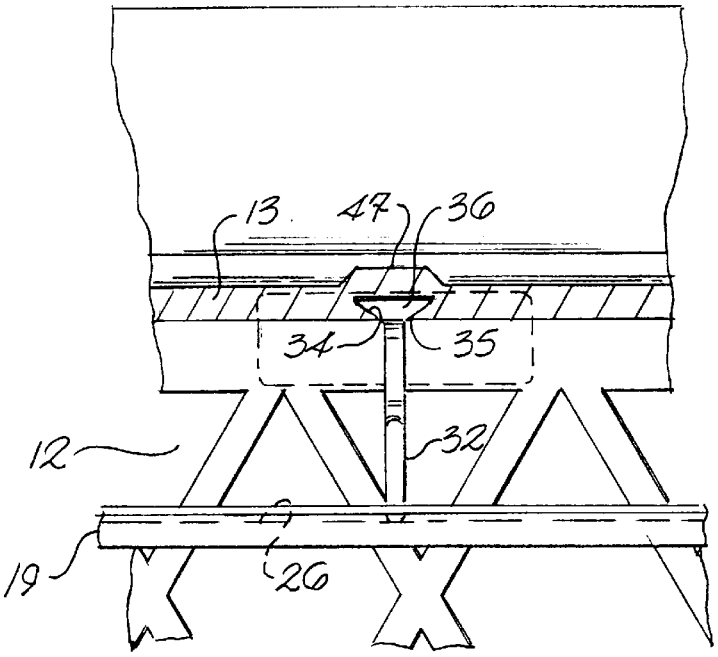
FIG. 3 illustrates a cross-sectional view taken along the lines 3—3 of FIG. 2 with the handle depicted in phantom with dashed line.

In further accordance with the present invention, a means is provided for selectively slidably translating the open (or first) override member with respect to the housing. As shown in FIG. 3 for example, the means for selectively slidably translating the first override member with respect to the housing includes a first guide 34 forming part of one of housing 11 and first override member 30. In the embodiment shown in FIG. 2, the first guide is an elongated linear track that is defined in top wall 13 of housing 11 and indicated in part by the dashed lines designated 34. As shown in FIG. 3, first guide 34 communicates with passageway 12 via an elongated slot 35. As shown in FIGS. 1–3, an extra thickness of material in the form of a first reinforcing rib 47 is provided in the outer surface of top wall 13 along the length of first guide 34. In an alternative embodiment (not shown), the first guide could be formed in an extra thickness of material disposed along the inner surface of top wall 13.

The means for selectively slidably translating the first override member with respect to the housing further includes a first slide forming part of the other of the housing and the first override member. In the embodiment of open override member 30 shown in FIG. 6A, a first slide 36 forms an elongated bar portion of main body 31. As shown in FIG. 3 for example, first slide 36 is slidably retained by first guide 34 and configured for selective slidable translation relative to first guide 34. In this way, first override member 30 can be slidably moved along the depth of passageway 12 of housing 11 between a first position at one extreme orientation of first handle 33 (shown in dashed line in FIG. 2) and a second position at the opposite extreme orientation of handle 33 (shown in solid line in FIG. 2).

Referring to FIG. 2, when first override member 30 is selectively placed in a first position relative to housing 11, the louvers are oriented as shown in solid line for first louver 19 in FIG. 2 and in dashed line in FIG. 9, which is the open orientation of passageway 12. When the operator pulls on first handle 33 to move first override member 30 to the second extreme position shown in dashed line in FIG. 2, the louvers are oriented as shown in dashed line for first louver 19 in FIG. 2 and solid line in FIG. 9. Thus, when first override member 30 has been selectively placed in this second position relative to housing 11, the temperature dependent opening and closing means is released from the open orientation previously described.

As shown in FIGS. 2 and 3, when first override member 30 is selectively disposed in the first position (solid line), first cam member 32 is configured to engage a flat upper surface portion 26 of first louver 19. As shown in FIG. 2, first cam member 32 of first override member 30 is configured to engage first louver 19 asymmetrically relative to the pivoting axis, which is centrally located in support post 21, to retain first louver 19 in an open orientation relative to passageway 12 when first override member 30 is disposed in the first position relative to housing 11.

Moreover, as shown in FIG. 2, when first override member 30 is disposed in the second position (dashed line) relative to housing 11, first cam member 32 (dashed line) is disposed in a second asymmetrical orientation relative to the pivoting axis of first louver 19. In this second position (shown in dashed line in FIG. 2) first cam member 32 is configured to disengage first louver 19 in order to release first louver 19, as well as the other louvers that form the temperature dependent opening and closing means, from the open orientation relative to passageway 12.

In accordance with the present invention, another override member is provided. Since this is the second such override member being discussed herein, it can be referred to herein as the second override member. The second override member is configured and disposed with respect to the housing so that when the second override member is selectively placed in a first position relative to the housing, the temperature dependent opening and closing means is held in a closed orientation relative to the passageway. This closed orientation of the temperature dependent opening and closing means is shown in FIG. 9 by the louvers 19, 19*a*, 19*b* drawn in solid lines and in FIGS. 2 and 4 by the louver 19 drawn in dashed lines. Because the second override member is associated with maintaining this closed orientation of air passageway 12, the second override member also can be referred to herein as the closed override member. Moreover, when the closed override member is selectively placed in a second position relative to the housing, the temperature dependent opening and closing means is released from being maintained in the closed orientation. This condition of being released from the closed orientation of the temperature dependent opening and closing means, is shown in FIG. 4 by the louver 19 drawn in solid lines.

As embodied herein and shown in FIGS. 6A and 4 for example, a closed (or second) override member is generally designated by the numeral 40. Second override member 40 includes a second main body 41 extending generally along a longitudinal axis of symmetry thereof. Second override member 40 includes a second cam member 42 extending generally normally from second main body 41.

As shown in FIG. 6B, second override member 40 also includes a second handle 43. As shown in FIGS. 4 and 6A for example, second handle 43 is configured to be connected together with second main body 41 to become integral with second main body 41 in the assembled ventilator. This can be accomplished by a sleeve 51 formed on handle 43 and having an internally disposed detent 52 (dashed line in FIG. 6B) that engages a complementarily configured groove 53 formed in one end of second main body 41. Alternatively, sleeve 51 could be formed on main body 41, and a groove 53 could be formed on a tongue extending from handle 43. As shown in FIG. 4, second handle 43 of second override member 40 is configured and disposed relative to housing 11 so as to be accessible manually by an operator of the ventilator.

In further accordance with the present invention, a means is provided for selectively slidably translating the closed (or second) override member with respect to the housing. As shown in FIG. 5 for example, the means for selectively slidably translating the second override member with respect to the housing includes a second guide 44 forming part of one of housing 11 and second override member 40. In the embodiment shown in FIG. 4, the second guide is an elongated linear track that is defined in the outer surface of top wall 13 of housing 11 and indicated in part by the dashed lines designated 44. As shown in FIG. 5, second guide 44 communicates with passageway 12 via an elongated slot 45. As shown in FIGS. 1, 4 and 5, an extra thickness of material in the form of a second reinforcing rib 48 is provided in top wall 13 along the length of second guide 44. In an alternative embodiment (not shown), the second guide could be formed in an extra thickness of material disposed along the inner surface of top wall 13.

The means for selectively slidably translating the second override member with respect to the housing further includes a second slide forming part of the other of the housing and the second override member. In the embodiment of closed override member 40 shown in FIG. 6A, a second slide 46 forms an elongated bar portion of main body 41. As shown in FIG. 5 for example, second slide 46 is slidably retained by second guide 44 and configured for selective slidable translation relative to second guide 44. In this way, second override member 40 can be slidably moved along the depth of passageway 12 of housing 11 between a first position at one extreme orientation of second handle 43 (shown in dashed line in FIG. 4) and a second position at the opposite extreme orientation of handle 43 (shown in solid line in FIG. 4).

Referring to FIG. 4, second override member 40 is configured so that when second override member 40 is selectively placed in a first position relative to housing 11, the louvers are maintained in the fully closed orientation, which is shown in dashed line for first louver 19 in FIG. 4 and solid line in FIG. 9. With louvers 19, 19*a*, 19*b* disposed in this closed orientation, passageway 12 is closed to the passage of air through ventilator 10, and second handle 43 is disposed relatively farthest from grille 39. When the operator pulls on second handle 43 to move second override member 40 to the second extreme position shown in solid line in FIG. 4, second override member 40 no longer maintains the louvers in the closed orientation. Thus, when second override member 40 has been selectively placed in this second position (solid line in FIG. 4) relative to housing 11, the temperature dependent opening and closing means is released from the closed orientation previously described.

As shown in FIGS. 4 and 5, second override member 40 is configured so that when second override member 40 is selectively placed in a first position (dashed line) relative to housing 11, second cam member 42 is configured to support the back surface 28 of first louver 19. As shown in FIG. 4, second cam member 42 of second override member 40 is configured to engage first louver 19 asymmetrically relative to the pivoting axis, which is centrally located in support post 21, to retain first louver 19 in a closed orientation relative to passageway 12 when second override member 40 is disposed in the first position relative to housing 11.

Moreover, as shown in solid line in FIG. 4, second cam member 42 of second override member 40 is configured to disengage first louver 19 in a second asymmetrical orientation relative to the pivoting axis of first louver 19 in order to release first louver 19, as well as the other louvers that form the temperature dependent opening and closing means, from the closed orientation relative to passageway 12 when second override member 40 is disposed in the second position relative to housing 11. In this fully released orientation (solid line in FIG. 4) of second override member 40, second cam member 42 is configured with a curved foot portion to support the rear upper free edge 27 of first louver 19, and second handle 43 is disposed relatively closest to grille 39.

Figures 7, 8:
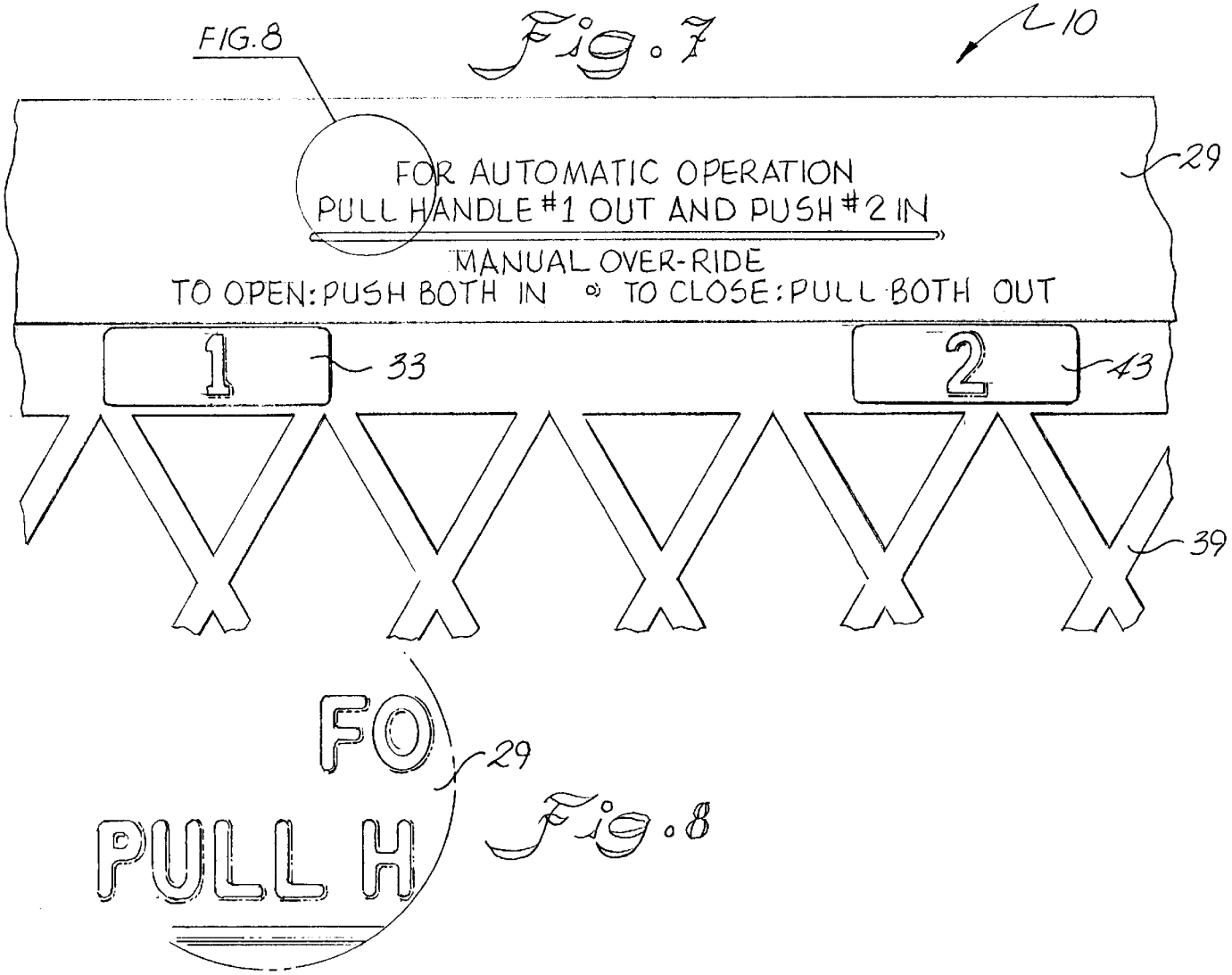
FIG. 7 illustrates a partial, front plan view of an embodiment of the ventilator of the present invention.
FIG. 8 illustrates a partial, expanded, front plan view of the circled portion of the view shown in FIG. 7.

As shown in FIG. 7 for example, operating instructions for the ventilator of the present invention are desirably imprinted on (or molded into as shown in detail in FIG. 8) the front face of the ventilator in the vicinity of first handle 34 and second handle 44. Thus, to configure ventilator 10 for conventional operation as an automatic temperature responsive ventilator, first handle 34 is disposed as shown in dashed line in FIG. 2, and second handle 44 is disposed as shown in solid line in FIG. 4. In this way, first override member 30 is disengaged from first louver 19, and second override member 40 is disposed with second cam member 42 acting as a stop that catches the rear upper free edge 27 of first louver 19 (solid line in FIG. 4).

By activating the manual override features of the present invention, one can either manually open vent 10 so that air can freely flow through passageway 12 or manually close vent 10 so that air is prevented from freely flowing through passageway 12. To configure ventilator 10 manually in the fully open position, first handle 33 is disposed as shown in solid line in FIG. 2, and second handle 43 is disposed as shown in solid line in FIG. 4. Alternatively, to configure ventilator 10 in the fully closed position, first handle 33 is disposed in the dashed line orientation of FIG. 2, and second handle 43 is disposed in the dashed line orientation of FIG. 4.

What is claimed is:

1. An automatic temperature actuating ventilator with manual override, comprising:

(a) a housing defining an air passageway therethrough;

(b) a means for selectively opening and closing said air passageway depending upon the temperature of the surrounding atmosphere, said temperature dependent opening and closing means includes at least one louver disposed in said air passageway; and (c) a first override member configured and disposed with respect to said housing so that when said first override member is selectively placed in a first position relative to said housing, said temperature dependent opening and closing means is held in an open orientation relative to said passageway.

2. An apparatus as in claim 1, wherein said first override member is further configured and disposed so that when said first override member is selectively placed in a second position relative to said housing, said temperature dependent opening and closing means is thereby released from said open orientation.

3. An apparatus as in claim 1, further comprising:

(d) a second override member configured and disposed with respect to said housing so that when selectively placed in a first position relative to said housing, said temperature dependent opening and closing means is held in a closed orientation relative to said passageway.

4. An apparatus as in claim 1, wherein said second override member is further configured and disposed so that when said second override member is selectively placed in a second position relative to said housing, said temperature dependent opening and closing means is thereby released from said closed orientation.

5. An automatic temperature actuating ventilator with manual override, comprising:

(a) a housing defining an air passageway therethrough;

(b) a means for selectively opening and closing said air passageway depending upon the temperature of the surrounding atmosphere, said temperature dependent opening and closing means includes at least one louver disposed in said air passageway; and (c) an override member configured and disposed with respect to said housing so that when said override member is selectively placed in a first position relative to said housing, said temperature dependent opening and closing means is thereby held in a closed orientation relative to said passageway.

6. An apparatus as in claim 5, wherein said override member is further configured and disposed so that when said override member is selectively placed in a second position relative to said housing, said temperature dependent opening and closing means is thereby released from said closed orientation.

7. An apparatus as in claim 5, further comprising:

(d) a second override member configured and disposed with respect to said housing so that when selectively placed in a first position relative to said housing, said temperature dependent opening and closing means is held in an open orientation relative to said passageway.

8. An apparatus as in claim 7, wherein said second override member is further configured and disposed so that when said second override member is selectively placed in a second position relative to said housing, said temperature dependent opening and closing means is released from said open orientation.

9. An apparatus as in claim 1, further comprising:

means for selectively slidably translating said first override member with respect to said housing.

10. An apparatus as in claim 9, wherein said means for selectively slidably translating said first override member with respect to said housing includes:

(a) a first guide forming part of one of said housing and said first override member; and (b) a first slide forming part of the other one of said housing and said first override member, said first slide being slidably retained by said first guide and configured for selective slidable translation relative to said first guide.

11. An apparatus as in claim 1, wherein said first override member includes a first main body and a first cam member extending from said first main body and configured to retain said temperature dependent opening and closing means in an open orientation relative to said passageway when said first override member is disposed in said first position relative to said housing.

12. An apparatus as in claim 11, wherein said louver defines a substantially flat portion, and said first cam member of said first override member is configured to engage said flat portion of said louver to retain said louver in an open orientation relative to said passageway when said first override member is disposed in said first position relative to said housing.

13. An apparatus as in claim 11, wherein said louver defines a pivoting axis and is pivotally mounted in said passageway about said pivoting axis, and said first cam member of said first override member is configured to engage said louver asymmetrically relative to said pivoting axis to retain said louver in an open orientation relative to said passageway when said first override member is disposed in said first position relative to said housing.

14. An apparatus as in claim 13, wherein said first cam member of said first override member is configured to engage said louver in a first asymmetrical orientation relative to said pivoting axis to retain said louver in an open orientation relative to said passageway when said first override member is disposed in said first position relative to said housing and wherein said first cam member of said first override member is configured to disengage said louver in a second asymmetrical orientation relative to said pivoting axis to release said louver from said open orientation relative to said passageway when said first override member is disposed in said second position relative to said housing.

15. An apparatus as in claim 11, wherein said first override member includes a first handle, said first main body and said first handle being configured to be connected together to become integral with one another in the assembled ventilator, said first handle being configured and disposed relative to said housing so as to be accessible manually by an operator of the ventilator.

16. An apparatus as in claim 3, further comprising:

means for selectively slidably translating said second override member with respect to said housing.

17. An apparatus as in claim 16, wherein said means for selectively slidably translating said second override member with respect to said housing includes:

(a) a second guide forming part of one of said housing and said second override member; and (b) a second slide forming part of the other one of said housing and said second override member, said second slide being slidably retained by said second guide and configured for selective slidable translation relative to said second guide.

18. An apparatus as in claim 3, wherein said second override member includes a main body and a second cam member connected to said main body at a predetermined distance from said main body, said second cam member being configured to retain said temperature dependent opening and closing means in a closed orientation relative to said passageway when said second override member is disposed in said first position relative to said housing.

19. An apparatus as in claim 18, wherein said louver defines a substantially flat portion, and said second cam member of said second override member is configured to engage said flat portion of said louver to retain said louver in a closed orientation relative to said passageway when said second override member is disposed in said first position relative to said housing.

20. An apparatus as in claim 18, wherein said louver defines a pivoting axis and is pivotally mounted in said passageway about said pivoting axis, and said second cam member of said second override member is configured to engage said louver asymmetrically relative to said pivoting axis to retain said louver in a closed orientation relative to said passageway when said second override member is disposed in said first position relative to said housing.

21. An apparatus as in claim 20, wherein said second cam member of said second override member is configured to engage said louver in a first asymmetrical orientation relative to said pivoting axis to retain said louver in a closed orientation relative to said passageway when said second override member is disposed in said first position relative to said housing and wherein said second cam member of said second override member is configured to engage said louver in a second asymmetrical orientation relative to said pivoting axis to release said louver from said closed orientation relative to said passageway when said second override member is disposed in said second position relative to said housing.

22. An apparatus as in claim 18, wherein said second override member includes a handle, said main body and said handle being configured to be connected together to become integral with one another in the assembled ventilator, said handle being configured and disposed relative to said housing so as to be accessible manually by an operator of the ventilator.

23. An Apparatus as in claim 1, wherein said temperature dependent opening and closing means includes:

(a) at least two elongated louvers, each said louver defining a respective pivoting axis and being pivotally mounted in said passageway about said respective pivoting axis;

(b) means for linking said louvers for simultaneous rotation about each said respective pivoting axis of each said louver; and (c) a bimetallic coil having one end connected to at least one of said louvers, said coil having a second end connected to said housing.

24. A temperature actuating ventilator with manual override, comprising:

(a) a housing defining an air passageway therethrough;

(b) a first elongated louver and a second elongated louver, each said louver being disposed within said passageway, each said louver defining a pivoting axis along the length of said louver and being pivotally mounted to said housing about said respective pivoting axis;

(c) a bimetallic coil having one end connected to said housing and a second end connected to at least one of said louvers;

(d) an elongated linkage element pivotally connected at a first site to said first louver and pivotally connected at a second site to said second louver;

(e) a first override member configured and disposed with respect to said housing so that when selectively placed in a first position relative to said housing each said louver is held in an open orientation relative to said passageway and when said first override member is selectively placed in a second position relative to said housing each said louver is released from said open orientation;

(f) wherein said first override member includes a first main body and a first cam member extending from said first main body;

(g) a first handle, said first main body and said first handle being configured to be connected together to become integral with one another in the assembled ventilator, said first handle being configured and disposed relative to said housing so as to be accessible manually by an operator of the ventilator;

(h) a first guide forming part of one of said housing and said first override member;

(i) a first slide forming part of the other one of said housing and said first override member, said first slide being slidably retained by said first guide and configured for selective slidable translation relative to said first guide so as to permit movement of said first override member between said first and second positions relative to said housing;

(j) wherein said first louver defines a substantially flat portion and said first cam member of said first override member is configured to engage said flat portion of said first louver in a first asymmetrical orientation relative to said pivoting axis of said first louver to retain said first louver in an open orientation relative to said passageway when said first override member is disposed in said first position relative to said housing.

25. An apparatus as in claim 24, further comprising:

(k) a second override member configured and disposed with respect to said housing so that when selectively placed in a first position relative to said housing each said louver is held in a closed orientation relative to said passageway and when said second override member is selectively placed in a second position relative to said housing each said louver is released from said closed orientation;

(f) wherein said second override member includes a second main body and a second cam member extending from said second main body;

(g) a second handle, said second main body and said second handle being configured to be connected together to become integral with one another in the assembled ventilator, said second handle being configured and disposed relative to said housing so as to be accessible manually by an operator of the ventilator;

(h) a second guide forming part of one of said housing and said second override member;

(i) a second slide forming part of the other one of said housing and said second override member, said second slide being slidably retained by said second guide and configured for selective slidable translation relative to said second guide so as to permit movement of said second override member between said first and second positions relative to said housing;

(j) wherein said second cam member of said second override member is configured to engage said flat portion of said first louver in a second asymmetrical orientation relative to said pivoting axis of said first louver to retain said first louver in an open orientation relative to said passageway when said second override member is disposed in said first position relative to said housing.

* * * * *